US007841020B2

(12) United States Patent
Mayfield et al.

(10) Patent No.: US 7,841,020 B2
(45) Date of Patent: Nov. 30, 2010

(54) EASY DONNING GARMENT

(75) Inventors: Frances W. Mayfield, Marietta, GA (US); Christina Mae Chingren Seward, Orlando, FL (US); Alice Susan Gordon, Roswell, GA (US); Theresa M. McCoy, Cumming, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 191 days.

(21) Appl. No.: 11/780,758

(22) Filed: Jul. 20, 2007

(65) Prior Publication Data

US 2009/0019622 A1 Jan. 22, 2009

(51) Int. Cl.
*A41D 13/00* (2006.01)

(52) U.S. Cl. ..... 2/69; 2/69.5; 2/72; 2/227; 2/232; 2/233; 2/269; 2/312; 2/313

(58) Field of Classification Search ..... 2/69, 2/69.5, 72, 227, 232, 233, 269, 312, 313
See application file for complete search history.

(56) References Cited

U.S. PATENT DOCUMENTS

| | | | | |
|---|---|---|---|---|
| 237,096 | A | 2/1881 | Delmonte | |
| 280,167 | A | 6/1883 | Ford | |
| 461,434 | A | 10/1891 | Henry | |
| 560,683 | A | 5/1896 | Bruckner | |
| 823,534 | A | 6/1906 | Hutchinson | |
| 1,085,399 | A | 1/1914 | Bauer | |
| 1,600,897 | A | 9/1926 | Lesser | |
| 2,153,068 | A | 4/1939 | Arden | |
| 2,187,447 | A | 1/1940 | Chait et al. | |
| 2,280,467 | A | 4/1942 | Blanc | |
| 2,524,448 | A | 10/1950 | Kaplan | |
| 2,719,981 | A | 10/1955 | Walter | |
| 2,777,130 | A | 1/1957 | Keller | |
| 2,846,686 | A * | 8/1958 | Tames | 2/114 |
| 3,276,944 | A | 10/1966 | Levy | |
| 3,328,809 | A | 7/1967 | Payane et al. | |
| 3,338,992 | A | 8/1967 | Kinney | |

(Continued)

FOREIGN PATENT DOCUMENTS

| | | |
|---|---|---|
| CA | 803714 | 1/1969 |

(Continued)

OTHER PUBLICATIONS

AATCC Test Method 127-1998, "Water Resistance: Hydrostatic Pressure Test," 1998, pp. 211-212.

(Continued)

*Primary Examiner*—Gary L Welch
*Assistant Examiner*—Alissa J Tompkins
(74) *Attorney, Agent, or Firm*—Nathan P. Hendon

(57) ABSTRACT

A protective garment configured to facilitate easy donning of the garment is described. The garment includes one or more foreshortening structures within the garment that allows for the arms and legs to be shorted into a donning configuration. This allows the garment to be handled and donned by the wearer, without the wearer touching an exterior surface of the garment or allowing any portion of the garment to touch another surface. A method of preparing a protective garment for donning and a method of donning such a garment is also disclosed.

19 Claims, 3 Drawing Sheets

U.S. PATENT DOCUMENTS

| | | | | |
|---|---|---|---|---|
| 3,341,394 | A | | 9/1967 | Kinney |
| 3,359,569 | A | | 12/1967 | Rotanz et al. |
| 3,419,908 | A | | 1/1969 | Germani |
| 3,496,572 | A | * | 2/1970 | Benno ..... 2/457 |
| 3,502,538 | A | | 3/1970 | Petersen |
| 3,502,763 | A | | 3/1970 | Hartmann |
| 3,542,615 | A | | 11/1970 | Dobo et al. |
| 3,625,206 | A | | 12/1971 | Charnley |
| 3,692,618 | A | | 9/1972 | Dorschner et al. |
| 3,774,240 | A | | 11/1973 | Johnson |
| 3,812,539 | A | | 5/1974 | Muehlberg et al. |
| 3,849,241 | A | | 11/1974 | Buntin et al. |
| 4,000,521 | A | | 1/1977 | Zoephel et al. |
| 4,041,203 | A | | 8/1977 | Brock et al. |
| 4,117,552 | A | | 10/1978 | Simpson |
| 4,149,275 | A | | 4/1979 | Sanchez |
| 4,200,938 | A | | 5/1980 | LeTourneau |
| 4,214,320 | A | | 7/1980 | Belkin |
| 4,340,563 | A | | 7/1982 | Appel et al. |
| 4,374,888 | A | | 2/1983 | Bornslaeger |
| 4,475,252 | A | | 10/1984 | Peyser et al. |
| 4,523,335 | A | | 6/1985 | Scrivens |
| 4,655,760 | A | | 4/1987 | Morman et al. |
| 4,657,802 | A | | 4/1987 | Morman |
| 4,705,171 | A | | 11/1987 | Eldridge |
| 4,720,415 | A | | 1/1988 | Vander Wielen et al. |
| 4,753,843 | A | | 6/1988 | Cook et al. |
| 4,773,100 | A | | 9/1988 | Kuo |
| 4,773,101 | A | | 9/1988 | Kapp et al. |
| 4,781,966 | A | | 11/1988 | Taylor |
| 4,783,854 | A | | 11/1988 | Björklund |
| 4,789,699 | A | | 12/1988 | Kieffer et al. |
| 4,942,987 | A | | 7/1990 | Stackhouse |
| 4,965,122 | A | | 10/1990 | Morman |
| 4,981,747 | A | | 1/1991 | Morman |
| 4,985,936 | A | | 1/1991 | Jones |
| 5,033,115 | A | | 7/1991 | Bowling et al. |
| 5,067,179 | A | | 11/1991 | Wormser |
| 5,097,534 | A | | 3/1992 | Viemeister et al. |
| 5,208,920 | A | | 5/1993 | Schaefer et al. |
| 5,213,881 | A | | 5/1993 | Timmons et al. |
| 5,226,992 | A | | 7/1993 | Morman |
| 5,299,323 | A | | 4/1994 | Schaefer et al. |
| 5,336,545 | A | | 8/1994 | Morman |
| 5,401,446 | A | | 3/1995 | Tsai et al. |
| 5,410,758 | A | | 5/1995 | Dupont et al. |
| 5,487,189 | A | | 1/1996 | Bell |
| 5,491,753 | A | | 2/1996 | Van Hout et al. |
| 5,511,246 | A | | 4/1996 | Farkas et al. |
| 5,535,453 | A | | 7/1996 | Howard |
| 5,539,932 | A | | 7/1996 | Howard |
| 5,575,010 | A | | 11/1996 | Chung |
| 5,787,511 | A | | 8/1998 | Garside |
| 5,867,825 | A | | 2/1999 | Scheerer |
| 5,960,473 | A | * | 10/1999 | Tajima ..... 2/69 |
| 6,029,274 | A | | 2/2000 | Welchel et al. |
| 6,148,445 | A | | 11/2000 | Spruill |
| 6,317,894 | B1 | | 11/2001 | Blechman |
| D534,334 | S | | 1/2007 | Davis |
| 7,168,103 | B2 | | 1/2007 | Aldridge et al. |
| 2003/0226196 | A1 | | 12/2003 | Grilliot |
| 2006/0064797 | A1 | | 3/2006 | Pyeatt Rowe et al. |
| 2006/0107437 | A1 | | 5/2006 | Griesbach, III |
| 2006/0185065 | A1 | | 8/2006 | Allen |
| 2006/0191054 | A1 | | 8/2006 | Noe |
| 2006/0272070 | A1 | | 12/2006 | Hakkarainen et al. |

FOREIGN PATENT DOCUMENTS

| | | | |
|---|---|---|---|
| DE | 040302713 | | 4/2004 |
| EP | 0136140 | A1 | 4/1985 |
| EP | 0280101 | A1 | 8/1988 |
| EP | 0507607 | A1 | 10/1992 |
| EP | 0507608 | A1 | 10/1992 |
| EP | 1068810 | A1 | 1/2001 |
| EP | 1563747 | A2 | 8/2005 |
| FR | 2329219 | A | 7/1977 |
| FR | 2601859 | A1 | 1/1988 |
| FR | 2756710 | A1 | 6/1998 |
| GB | 160385 | | 3/1921 |
| GB | 883413 | | 11/1961 |
| GB | 952125 | | 3/1964 |
| GB | 1492553 | | 11/1977 |
| GB | 2155761 | | 10/1985 |
| GB | 2269085 | | 2/1994 |
| WO | WO 89/08994 | | 10/1989 |
| WO | WO 93/15621 | | 8/1993 |
| WO | WO 2005/065475 | | 7/2005 |
| WO | WO 2005/065476 | | 7/2005 |
| WO | WO 2006/038913 | | 4/2006 |

OTHER PUBLICATIONS

ASTM Designation: D737-96, "Standard Test Methods for Air Permeability of Textile Fabrics", Published Apr. 1996, pp. 207-211.
ASTM Designation: E 96-80, "Standard Test Methods for Water Vapor Transmission of Materials", Published Feb. 1981, pp. 87-96.
Federal Test Method Standard No. 191A, Method 5450, "Permeability to Air; Cloth; Calibrated Orifice Method", Jul. 1978.
Lawrence, K.D. et al., *NRL Report 5265*, "An Improved Device for the Formation of Superfine Thermoplastic Fibers", Feb. 1959.
Wente, V.A. et al., *NRL Report 4364*, "Manufacture of Super-Fine Organic Fibers", May 1954.

* cited by examiner

EASY DONNING GARMENT

BACKGROUND

There are many types of limited-use or disposable protective garments designed to provide barrier properties. One type of protective apparel is protective coveralls. For example, garments, such as coveralls, can be used to effectively seal off a wearer from a harmful environment in ways that open or cloak style garments such as, for example, drapes, gowns and the like are unable to do. Accordingly, coveralls have many applications where isolation of a wearer is desirable. Such protective apparel keeps clothing clean and keeps dirt and other residue off of the wearer's skin. For a variety of reasons, it is undesirable for hazardous liquids and/or pathogens that may be carried by liquids to pass through protective apparel. It is also highly desirable to use protective apparel to isolate persons from dusts, powders, and other particulates that may be present in a work place or accident site. Conversely, in cleanroom, critical manufacturing, and surgical environments, the protective apparel protects the environment from dust and debris that may otherwise be carried into the environment by the wearer.

Cleanroom manufacturing environments require garments to separate workers from the article being worked upon. Sometimes this is due to environments where the environs could harm the worker, however, more often it is due to the desire to protect the item from debris or contaminants the worker may introduce. For example, in aseptic manufacturing, the various components are sterile when introduced to the aseptic environment and are assembled in the aseptic environment such that the resultant assembled article need not be sterilized. Such a manufacturing process is often seen within the manufacturing and packaging of certain pharmaceuticals. Such critical environments are also found in other areas such as some surgical environments.

Due to the critical, sterile character of such environments, stringent protocols regarding apparel and apparel donning are followed such that no contaminants, including things such as dead skin and natural bacteria which may be present on workers' skin, are not accidentally transferred to the product or patient that the environment is structured to protect. To prevent this, workers will don head-to-toe coverage, including booties, gloves, and coveralls, to protect the environment. To ensure cleanliness, workers undergo extensive training regarding the donning of such garments. Protective garments are donned in such a way so that the worker is careful to don the garment without touching an exterior surface of the garment and ensure that the garment does not touch the floor. If either occurs, the worker must obtain another garment to don.

Typically, careful donning of the garments begins with the worker reaching into the garment and grasping the arm and leg cuffs from the inside of the garment. The worker will then insert one leg at a time, being careful that the leg is not allowed to touch the floor. The worker then puts on the garment one arm at a time. During these donning steps, the worker must balance and contort their body to don the garment while not touching an external surface of the garment. Such donning takes training, practice, and a high degree of balance.

Various patent references describe protective garments adapted for donning. For example, one such garment is disclosed in U.S. Pat. No. 5,867,825 to Scheerer. That patent is directed to a garment package that is to facilitate donning of the garment in which the garment is pre-cuffed (interior portion of garment near opening is exposed). The wearer inserts arms and legs and dons the pre-cuffed garment. Finally, the wearer must roll down the cuffs by grasping the exposed interior surface of the cuff and rolling the cuff down.

Workers typically change their coverall once a day, or every other day, depending on the requirements or standards of their respective industry. In some situations, workers may change their protective apparel even more frequently. After use, it can be quite costly to decontaminate, clean, and/or sterilize protective apparel after it has been used. Thus, it is important that protective apparel be inexpensive so as to be disposable. Generally speaking, protective coveralls are made from barrier materials/fabrics engineered to be relatively impervious to liquids and/or particulates as well as being low-linting. The cost of such materials as well as the coveralls' design and construction are important factors affecting cost. Desirably, all of these factors should be suited for the manufacture of protective garment, such as coveralls, at such low cost that it may be economical to discard the coveralls, if necessary, after only a single use.

DEFINITIONS

As used herein, the term "nonwoven-based material" or "nonwoven web" refers to a material or web that has a structure of individual fibers or filaments which are interlaid, but not in an identifiable repeating manner. Nonwoven webs have been, in the past, formed by a variety of processes known to those skilled in the art such as, for example, meltblowing, spunbonding and bonded carded web processes.

As used herein, the term "spunbonded web" refers to a web of small diameter fibers and/or filaments which are formed by extruding a molten thermoplastic material as filaments from a plurality of fine, usually circular, capillaries in a spinnerette with the diameter of the extruded filaments then being rapidly reduced, for example, by non-eductive or eductive fluid-drawing or other well known spunbonding mechanisms. The production of spunbonded nonwoven webs is illustrated in patents such as Appel, et al., U.S. Pat. No. 4,340,563; Dorschner et al., U.S. Pat. No. 3,692,618; Kinney, U.S. Pat. Nos. 3,338,992 and 3,341,394; Levy, U.S. Pat. No. 3,276,944; Peterson, U.S. Pat. No. 3,502,538; Hartman, U.S. Pat. No. 3,502,763; Dobo et al., U.S. Pat. No. 3,542,615; and Harmon, Canadian Patent No. 803,714.

As used herein, the term "meltblown fibers" means fibers formed by extruding a molten thermoplastic material through a plurality of fine, usually circular, die capillaries as molten threads or filaments into a high-velocity gas (e.g. air) stream which attenuates the filaments of molten thermoplastic material to reduce their diameters, which may be to microfiber diameter. Thereafter, the meltblown fibers are carried by the high-velocity gas stream and are deposited on a collecting surface to form a web of randomly disbursed meltblown fibers. The meltblown process is well-known and is described in various patents and publications, including NRL Report 4364, "Manufacture of Super-Fine Organic Fibers" by V. A. Wendt, E. L. Boone, and C. D. Fluharty; NRL Report 5265, "An Improved device for the Formation of Super-Fine Thermoplastic Fibers" by K. D. Lawrence, R. T. Lukas, and J. A. Young; and U.S. Pat. No. 3,849,241, issued Nov. 19, 1974, to Buntin, et al.

As used herein, the term "microfibers" means small diameter fibers having an average diameter not greater than about 100 microns, for example, having a diameter of from about 0.5 microns to about 50 microns, more specifically microfibers may also have an average diameter of from about 1 micron to about 20 microns. Microfibers having an average diameter of about 3 microns or less are commonly referred to as ultra-fine microfibers. A description of an exemplary process of making ultra-fine microfibers may be found in, for example, U.S. Pat. No. 5,213,881.

As used herein, the terms "sheet" and "sheet material" shall be interchangeable and in the absence of a word modifier, refer to a material that may be a film, nonwoven web, woven fabric or knit fabric.

As used herein, the term "machine direction" (hereinafter "MD") refers to the planar dimension of a material web, which is in the direction of a material parallel to its forward direction during processing. The term "cross-machine direction" (hereinafter "CD") refers to the planar dimension of a material, which is in the direction that is generally perpendicular to the machine direction.

As used herein, the term "liquid resistant" refers to material having a hydrostatic head of at least about 25 centimeters as determined in accordance with the standard hydrostatic pressure test AATCCTM No. 1998 with the following exceptions: (1) the samples are larger than usual and are mounted in a stretching frame that clamps onto the cross-machine direction ends of the sample, such that the samples may be tested under a variety of stretch conditions (e.g., 10%, 20%, 30%, 40% stretch); and (2) the samples are supported underneath by a wire mesh to prevent the sample from sagging under the weight of the column of water.

As used herein, the term "breathable" refers to material having a Frazier porosity of at least about 25 cubic feet per minute per square foot (cfm/ft$^2$). For example, the Frazier porosity of a breathable material may be from about 25 to more than 45 cfm/ft$^2$. The Frazier porosity is determined utilizing a Frazier Air Permeability Tester available from the Frazier Precision Instrument Company. The Frazier porosity is measured in accordance with Federal Test Method 5450, Standard No. 191A, except that the sample size is 8"×8" instead of 7"×7".

As used herein, the term "particle resistant" refers to a fabric having a useful level of resistance to penetration by particulates. Resistance to penetration by particulates may be measured by determining the air filter retention of dry particles and can be expressed as particle holdout efficiency. More specifically, particle hold-out efficiency refers to the efficiency of a material at preventing the passage of particles of a certain size range through the material. Particle holdout efficiency may be measured by determining the air filter retention of dry particles utilizing tests such as, for example, IBR Test Method No. E-217, Revision G (1/15/91) performed by InterBasic Resources, Inc. of Grass Lake, Mich. Generally speaking, high particle holdout efficiency is desirable for barrier materials/fabrics. Desirably, a particle resistant material should have a particle holdout efficiency of at least about 40 percent for particles having a diameter greater than about 0.1 micron. LMS Labs are used to substantiate claims made in catalog. The apparel catalog references air permeability ASTM D737 and Moisture Vapor Transport Rate ASTM E96 as methods related to comfort properties.

As used herein, the term "elastomeric" refers to a material or composite which can be extended or elongated by at least 25% of its relaxed length and which will recover, upon release of the applied force, at least 10% of its elongation. It is generally preferred that the elastomeric material or composite be capable of being elongated by at least 100%, recover at least 50% of its elongation. An elastomeric material is thus stretchable and "stretchable", "elastomeric", and "extensible" may be used interchangeably.

As used herein, the terms "elastic" or "elasticized" means that property of a material or composite by virtue of which it tends to recover towards its original size and shape after removal of a force causing a deformation.

As used herein, the term "necked-bonded" laminate refers to a composite material having an elastic member that is bonded to a non-elastic member while the non-elastomeric member is extended in the machine direction creating a necked material that is elastic in the transverse or cross-direction. Examples of necked-bonded laminates are disclosed in U.S. Pat. Nos. 4,965,122; 4,981,747; 5,226,992; and 5,336,545.

As used herein, the term "stretch-bonded" laminate refers to a composite material having at least two layers in which one layer is a gatherable layer and the other layer is an elastic layer. The layers are joined together when the elastic layer is in an extended condition so that upon relaxing the layers, the gatherable layer is gathered. For example, one elastic member can be bonded to another member while the elastic member is extended at least about 25% of its relaxed length. Such a multiplayer composite elastic material may be stretched until the non-elastic layer is fully extended. Examples of stretch-bonded laminates are disclosed, for example, in U.S. Pat. Nos. 4,720,415, 4,789,699, 4781,966, 4,657,802, and 4,655,760.

As used herein, the term "disposable" is not limited to single use articles but also refers to articles that are so relatively inexpensive to the consumer that they can be discarded if they become soiled or otherwise unusable after only one or a few uses.

As used herein, the term "garment" refers to protective garments and/or shields including for example, but not limited to surgical gowns, patient drapes, work suits, coveralls, jumpers, aprons, and the like.

As used herein, the term "coverall" refers to a relatively loose fitting, one-piece, protective garment that can be worn over other articles of clothing and protects substantial areas of a wearer's body, typically, from the neck region over the trunk of the body and out to the ends of extremities, such as a wearer's wrists and ankles, which sometimes may include the hands and feet. In some embodiment, the garment may include an attached head cover, such as a hood, or integrated gloves and socks, boots, or other footwear.

As used herein, the term "polymer" generally includes, but is not limited to, homopolymers, copolymers, such as, for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to, isotactic, syndiotactic and random symmetries.

As used herein, the term "consisting essentially of" does not exclude the presence of additional materials which do not significantly affect the desired characteristics of a given composition or product. Exemplary materials of this sort would include, without limitation, pigments, antioxidants, stabilizers, surfactants, waxes, flow promoters, particulates or materials added to enhance ability to process of a composition.

As used herein, the term "couple" includes, but is not limited to, joining, connecting, fastening, linking, or associating two things integrally or interstitially together. As used herein, the term "releaseably connect(ed)" refers to two or more things that are stably coupled together and are at the same time capable of being manipulated to uncouple the things from each another.

As used herein, the term "configure" or "configuration" means to design, arrange, set up, or shape with a view to specific applications or uses. For example: a military vehicle that was configured for rough terrain; configured the computer by setting the system's parameters.

As used herein, the term "substantially" refers to something which is done to a great extent or degree; for example, "substantially covered" means that a thing is at least 95% covered.

As used herein, the term "alignment" refers to the spatial property possessed by an arrangement or position of things in a straight line or in parallel lines.

As used herein, the terms "orientation" or "position" used interchangeably herein refer to the spatial property of a place where or way in which something is situated; for example, "the position of the hands on the clock."

SUMMARY OF THE INVENTION

In light of the problems discussed above, a need exists for an inexpensive protective garment that allows for a wearer to easily don the garment without touching the exterior of the garment and simultaneously preventing the garment from touching any other surface.

The present invention is directed to a sterile protective garment having a body portion, left and right legs extending from the body portion, and left and right sleeves extending from the body portion. Additionally, each sleeve and each leg have an opening that is distal to the body portion, where each of such openings has a donning loop associated with the opening. Finally, the garment has a donning configuration in such the sleeves and legs are foreshortened.

In some embodiments the garment includes a sheath on an interior surface of a portion of each leg and each sleeve. Additionally, each sheath has an anchor strip within the sheath, where the anchor strip may be used to foreshorten the legs and sleeves.

The present invention is also directed to a method of preparing such a protective garment for donning. The method includes the steps of first providing such a garment and then foreshortening the sleeves and legs of the garment by manipulation of the anchor strip. In some embodiments of the method, the garment may additionally be folded in such a way that an interior surface of the garments is available for the wearer to grasp. Some embodiments of the method includes the further steps of placing the folded garment in a bag, sealing the bag to form a garment package, and sterilizing the garment package. Such a folded garment package may be vacuum-packaged.

Finally, the present invention is also directed to a method of donning a sterile garment that has been foreshortened into a donning configuration. The donning method includes the step of first grasping the folded garment by the interior surface without touching the exterior surface and without allowing any part of the garment to touch the floor. Then the wearer inserts a foot and leg into the appropriate leg of the garment and places their foot into the donning loop of the distal opening of the leg. This is then repeated for the other leg. With both legs in the legs of the garment, the wearer pulls the body portion of the garment over their torso and thus extends the legs of the garment to the full length of their legs. Then the wearer inserts a hand and arm into the appropriate sleeve of the garment, placing their thumb or finger into the donning loop of the distal opening of the sleeve. This is then repeated for their other arm. Finally, the wearer fully extends the sleeves of the garment to the full length of their arms and closes the garment.

DETAILED DESCRIPTION

The present invention pertains to a limited-use protective garment having a foreshortening structure that allows the garment to be configured into a donning configuration to facilitate easy donning of the garment. Such garments are of particular interest to work areas and industries such as, for example, healthcare, home improvement do-it-yourself, chemical, industrial, sanitation, cleanrooms, and other similar applications.

Figure 1:
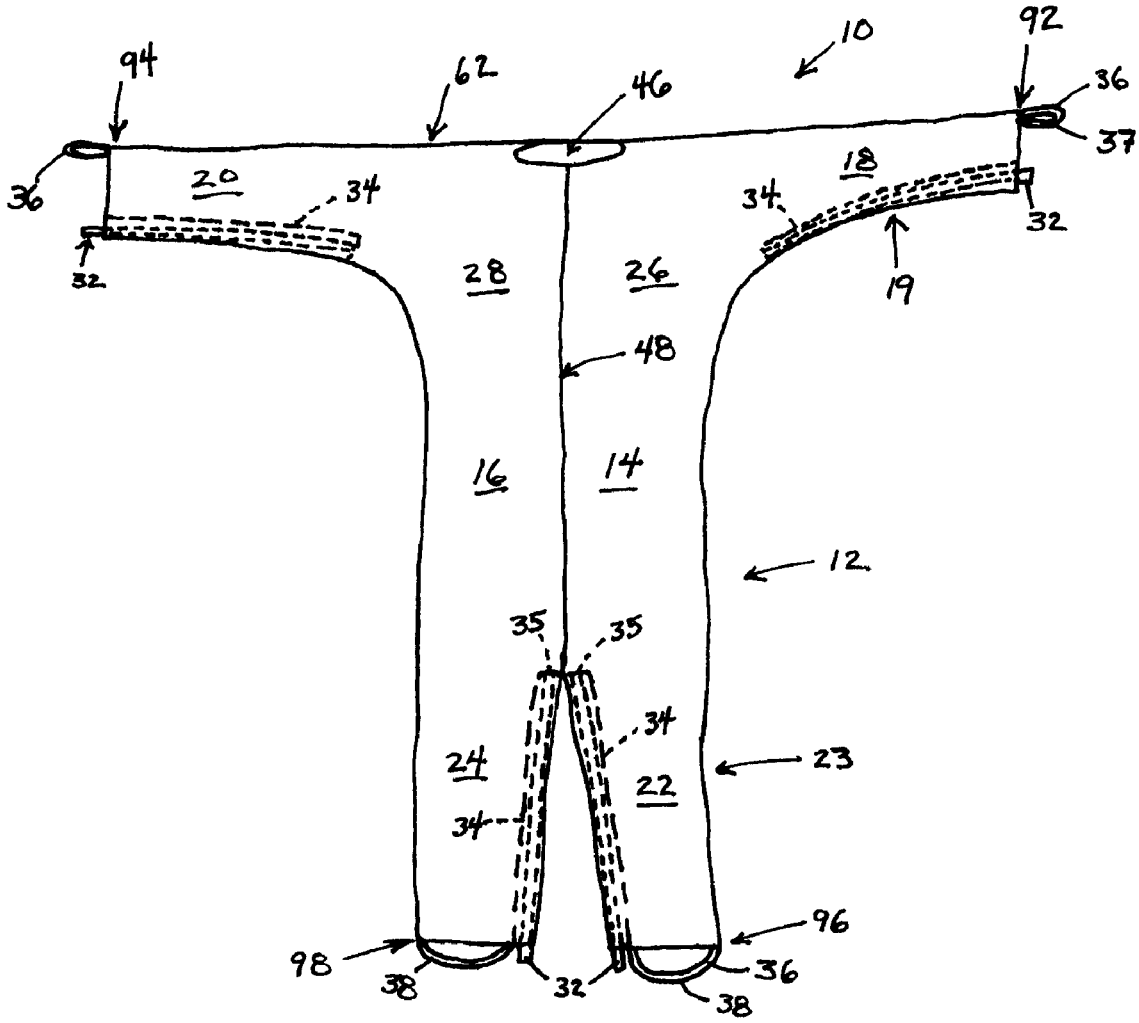
FIG. 1 illustrates a front view of exemplary protective garment according to the present invention.

Turning to FIG. 1, there is shown a front view 12 of a garment 10 embodying the present invention. The protective garment 10 includes a body portion made up of a left body panel 14 and a right body panel 16. It is desirable that each body panel 14, 16 is formed from a seamless sheet of material. The right body panel 16 is substantially a mirror image of the left body panel 14. The protective garment 10 includes left and right sleeves 18, 20 as well as left and right legs 22, 24. A neck opening 46 is visible at the top of the garment 10. As shown in FIG. 1, a closure means 48 extends from the neck opening 46 toward the crotch of the garment 10.

The manufacture of such garments 10 may be in accordance with known automated, semi-automated, or hand assembly procedures. It is desired that the protective garment contains the fewest practical number of panels, portions or sections in order to reduce the number of seams in the garment for better barrier properties and to simplify the manufacturing steps. However, it is contemplated that the protective garment of the present invention may contain sections, panels, or portions of barrier fabrics that may have different degrees of strength to customize the coverall for a particular application. For example, the sleeve portions or other portions (e.g., leg portions, shoulder portions or back portions of the coveralls) may include double layers of barrier fabrics with very high levels of strength and toughness. Examples of the type of garments 10 contemplated may be found in U.S. Pat. No. 5,487,189 to Bell, which is herein incorporated by reference, and in those garments available from Kimberly-Clark Corporation (Roswell, Ga.) sold under the KLEENGUARD® brand.

Figure 3:
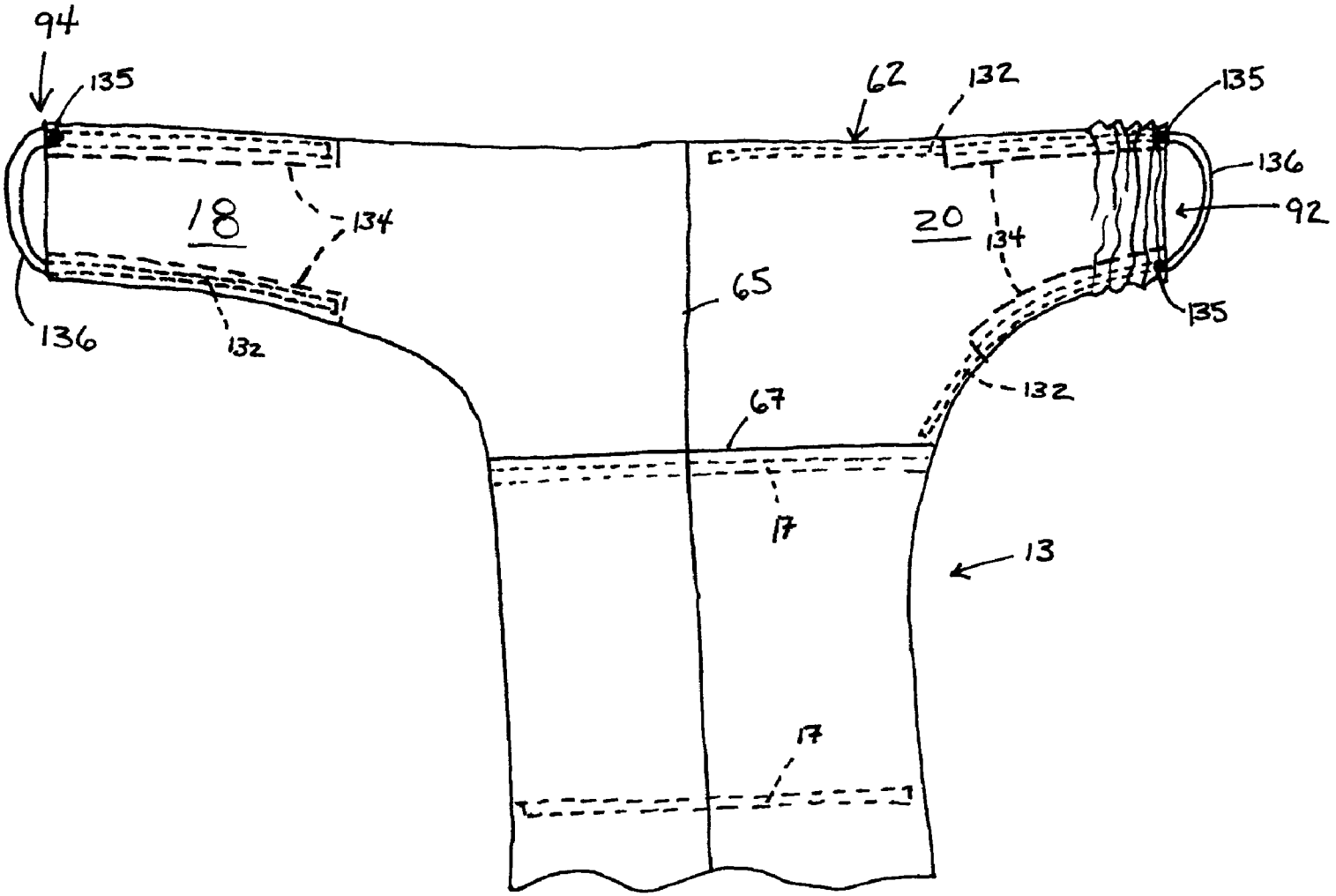
FIG. 3 illustrates a rear partial view of upper portion of an exemplary protective garment according to the present invention and illustrating one sleeve in a foreshortened donning configuration.

Desirably, the left sleeve 18 may be an integral part of the left body panel 14 (i.e., the left body panel 14 cut to form a left sleeve 18). It is contemplated that the left sleeve 18 may be a separate piece of material that may be joined to the upper left body panel 26 by a seam (not shown). In the same way, it is desirable that the right sleeve 20 may be an integral part of the right body panel 16 (i.e., the right body panel 16 cut to form a right sleeve 20). It is contemplated that the right sleeve 20 may be a separate piece of material that may be joined to the upper right body panel 28 by a seam (not shown). A closure means 48 joins the left body panel 14 to the right body panel 16 on the front 10 of the garment 10. As shown in FIG. 3, a vertical back seam 65 joins the body panels 14,16 to each other on the back of the garment 10. Additionally, a horizontal back seam 67 joins a front portion of the upper body panels 26, 28 that extend over the shoulder 62 and to another portion of the body panels 14,16 that extend around the sides of the garment 10 to the back side 13.

Figure 2:
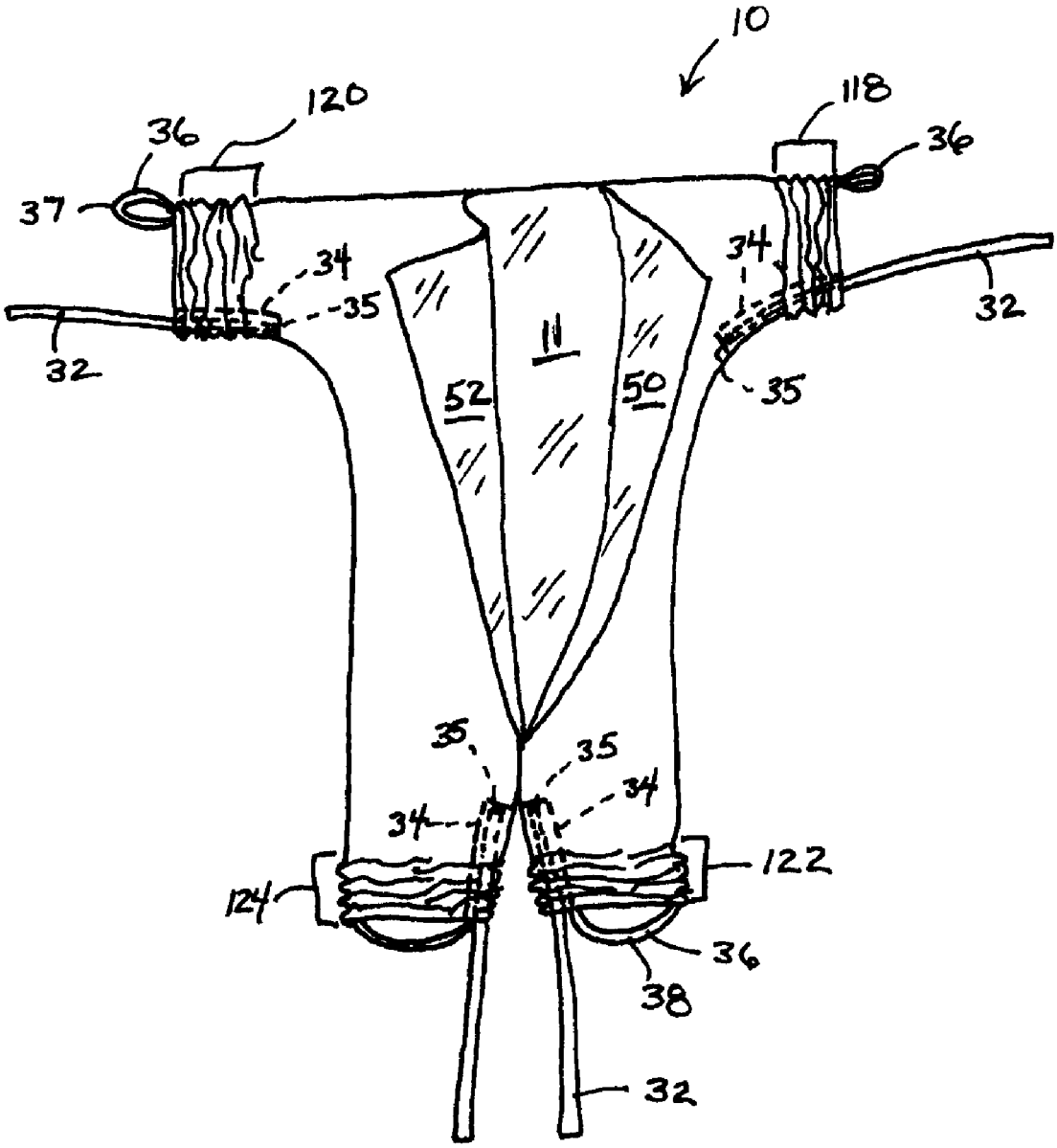
FIG. 2 illustrates a donning configuration of the exemplary protective garment of FIG. 1.

In the garment 10 illustrated in FIGS. 1 to 3, the sleeves 18, 20 are shown as extending outward from the body substantially parallel with the shoulder portions 62. However, other designs are possible. For example, the sleeves may be designed to extend upward from the general plane of the shoulder portions 62.

Desirably, the legs 22, 24 are formed in a way similar to the formation of the sleeves 18, 20. Desirably, the left leg 22 may be an integral part of the left body panel 14 (i.e., the left body panel 14 cut to form a left leg 22). It is contemplated that the left leg 22 may be a separate piece of material that may be joined to the left body panel 14 by a seam (not shown). In the same way, it is desirable that the right leg 24 may be an integral part of the right body panel 16 (i.e., the right body panel 16 cut to form a right leg 24). It is contemplated that the right leg 24 may be a separate piece of material that may be joined to the right body panel 16 by a seam (not shown).

Desirably, the left body panel 14 and the right body panel 16 are constructed such that the left and right upper sections 26, 28 and the left and right leg sections 22, 24 of the garment 10 corresponding to the left and right body panels 14, 16 are each made from single, or integral, pieces of material. Although less desirable, it is contemplated that seams (not shown) may be used to join the upper sections 26, 28 to the leg sections 22, 24, to join the sleeves 18, 20 to the upper sections 26, 28, or to join combinations thereof.

As shown in FIGS. 1 and 2, the sleeves 18, 20 include wrist openings 92, 94 at the distal ends of the sleeves 18, 20. Each of the sleeves 18, 20 include a donning loop 36 associated with the opening. Similarly, each of the legs 22, 24 include a donning loop 36 associated with the ankle openings 96, 98 at the distal end of each of the legs 22, 24. For the particular garment 10 illustrated in FIG. 1 and 2, the donning loop 36 associated with the wrists 92, 94 are thumb loops 37, while the donning loops 36 associated with the ankles 96, 98 are stirrups 38.

Additionally, each of the sleeves 18, 20 and legs 22, 24 include a foreshortening structure present on a portion of the interior surface 11 of the garment 10. This foreshortening structure is a combination of an anchor strip 32 within a tubular sheath 34. The anchor strip 32 is anchored at one end of the tubular sheath 34, which allows the manufacturer to foreshorten the sleeves 18, 20 and legs 22, 24, such as shown in FIG. 2, prior to providing the garment 10 to the end user.

For the garment 10 illustrated in FIGS. 1 and 2, there is a single sheath 34 present on the interior surface 11 of each of the sleeves 18, 20 and for each of the legs 22, 24. The sheaths 34 present within the sleeves 18, 20 extend above the elbow 19 of the garment 10 and the anchor strip 32 is anchored at an anchor point 35 at the end of the sheath 34, within the sleeves 18, 20. The manufacturer configures the garment 10 in the foreshortened configuration of FIG. 2 by grasping the anchor strip 32 and pushing the sleeve 18 or 20 back towards the upper body portions 26 or 28 of the garment 10. This produces a foreshortened, or gathered, sleeve portions 118, 120 with a length of anchor strip 32 extending from the wrist openings 92, 94.

Similarly, the sheaths 34 present within the legs 22, 24 extend above the knee 23 of the garment 10 and the anchor strip 32 is anchored at an anchor point 35 at the end of the sheath 34, within the sleeves 18, 20. The manufacturer configures the garment 10 in the foreshortened configuration of FIG. 2 by grasping the anchor strip 32 and pushing the leg 22 or 24 upwards towards the body portions 14 or 16 of the garment 10. This produces a foreshortened, or gathered, leg portions 122,124 with a length of anchor strip 32 extending from the ankle openings 96, 98.

The anchor points 35 may be any bonding means, attachment means, or structure that holds the anchor strip 32 in place such that the limbs of the garment 10 may be foreshortened (gathered) to facilitate easy donning. For example, the anchor points 35 may be an adhesive that attaches the end of the strip 32 to the sheath 34. Alternatively, the strip 32 may be physically stitched to the sheath 34 at the anchor point 35. Instead of an adhesive or stitch, or possibly in addition to such, the strip 32 may be attached to the sheath 34 by an ultrasonic bond.

The sheath 34 and anchor strip 32 are constructed to cooperate to allow the limbs of the garment 10 to be foreshortened, keep the garment 10 in such a donning configuration prior to donning, and allow the wearer to re-lengthen the sleeves 18, 20 and legs 22,24 while the garment 10 is being donned. To that end, the sheath 34 and anchor strip 32 are constructed with cooperative dimensions (i.e., compatible relative cross-sectional areas) such that the sheath 34 can pass along the anchor strip 32, but not pass so easily that the garment 10 cannot be held in the donning configuration prior to donning. To ensure elimination of the possibility of linting, all of seams of the sheath 34, anchor strip 32, and the garment 10 may be bound, or raw edges of the materials used may be otherwise encased. Finally, the sheaths 34 may be tubular structures that are attached to the interior surface 11 of the garment 10 or they may instead be extensions of the edge of the garment material, at the garment seams, which is pulled over back upon itself to form the sheath 34.

While the sheaths 34 and anchor strips 32 of FIGS. 1 and 2 are shown extending above the elbows 19 of the sleeves 18, 20 and above the knees 23 of the legs 22, 24, other configurations are considered. The lengths of the sheaths 34 and anchor strips 32 may be longer or shorter than illustrated. The anchor strips 32 may be shorter than the sheaths 34 such that when the garment 10 is donned, the anchor strips 32 will be pulled within the sheath 34 as the wearer extends their arms and legs within the garment 10. This may be accomplished by using a shorter anchor strip 34, or by merely cutting the anchor strip 32 to a shorter length after the sleeves 18, 20 and legs 22, 24 have been foreshortened in preparing the garment 10 for donning.

FIG. 3 illustrates a partial rear view 13 of another exemplary protective garment 10, similar to the garment 10 of FIG. 1. The garment 10 of FIG. 3 has the same basic structure of the garment 10 of FIGS. 1 and 2. However, the garment 10 of FIG. 3 utilizes a different foreshortening structure associated with its wrist openings 92, 94. The protective garment 10, in FIG. 3, illustrates left and right sleeves 18, 20 in reversed position of the rear view 13 of the garment 10.

Instead of being anchored at a point 35 at the end of the sheath 34 within the interior of the garment 10, as illustrated in FIGS. 1 and 2, the anchor strip 132 may be anchored at a point 135 of the sheath 134 near the wrist or ankle openings, as illustrated in FIG. 3. In this orientation, the sleeves 18, 20 are foreshortened by pulling the anchor strip 132 within the interior of the garment 10 to pull the wrists 92, 94 toward the upper body panels 26, 28 of the garment 10.

Additionally, the embodiment of FIG. 3 also illustrates the possibility that the donning loop 136 may be a portion of an anchor strip 132. As shown in FIG. 3, a single anchor strip 132 extends though a pair of sheaths 134 and across the wrist openings 92, 94. The anchor strip 132 is anchored at a pair of anchor points 135 within the wrist openings 92, 94 of the sleeves 18, 20. Such a donning loop 136 and sheaths 134 could also be used for the donning loop 36 at the ankle openings 96, 98 at the ends of the legs 22, 24 (not shown).

The garments 10 illustrated in FIGS. 1 to 3 all include individual sheaths 34,134 associated with each of the sleeve and leg openings. Alternatively, sheaths 34 may be shared by more than one of the openings of the garment 10. For example, a single sheath 34 may extend from the left sleeve opening 92, across the interior surface 11 of the back of the garment 10, and extend to the right sleeve opening 94. In such an exemplary embodiment, a single anchor strip 32 may be used, with a shared anchor point 35 in the center of the garment 10. Similarly, a single sheath 34 may be used to extend along the seam that extends from the left leg opening 96, up to the crotch of the garment 10, and down to the right leg opening 98.

One skilled in the art would be able to see how various design and component combinations of the sheaths 34,134, anchor strips 32,132, donning loops 36,136, and anchor points 35,135 could be configured to produce variations of the inventive foreshortening structures of the present invention. Such foreshortening structures provide the garment 10 with the ability to form a foreshortened donning configuration that facilitates easy donning of the garment.

Such a garment 10 may be packaged by any means and/or method that allows for the wearer to easily access the garment 10 for donning, while ensuring that the wearer does not touch an exterior surface of the garment 10. One exemplary method of preparing the garment 10 for donning may include the first step of first foreshortening the sleeves 18, 20 and legs 22, 24 of the garment 10. As discussed above for the garment 10 illustrated in FIGS. 1 and 2, the manufacturer would push the openings 92, 94, 86, 98 of the limbs toward the body portions 26, 28, 14, 26 of the garment, while holding on to the anchor strip 32. A garment 10 in such a resultant donning configuration is illustrated in FIG. 2, which shows the gathered foreshortened sleeves 118, 120 and gathered foreshortened legs 122, 124.

Next, with the front side 12 of the garment 10 laying against a table, the gathered sleeves 118, 120 may then be folded toward the back side 13 of the garment. Similarly, the gathered legs 122, 124 may then be folded up toward the back side 13 of the garment 10, on top of the folded gathered sleeves 118, 120. Finally, the partially folded garment 10 may be flipped over such that the closure means 48 is facing upwards. The closure means 48 may be opened and the left and right opening flaps 50, 52 may be pulled open and around to the back 13 of the partially folded garment 10 such that only the interior surface 11 of the garment 10 is exposed on the outside of the folded garment.

This method of folding of the garment 10 is only one potential method of folding the garment 10. Other methods that foreshortened the sleeves 118, 120 and the legs 122, 124 and fold the garment 10 such that the interior surface 11 is made available to the wearer during subsequent unfolding and donning are also contemplated by this invention. One skilled in the art would see how a different order of folding steps, numbers of folds, desired final folded dimensions, and other such considerations, may contribute to different methods of folding up the garment 10 of the present invention in its donning configuration.

Additionally, it may additionally be desirable to tuck the donning loops 36 into the wrist openings 92, 94 of the gathered sleeves 118, 120 and the ankle openings 96, 98 of the gathered legs 122, 124 such that the donning loops 36 are available on the inside of the garment 10 when the wearer later dons such a garment 10. It may also be desirable to tuck the anchor strips 32, 132 inside the gathered sleeve 118, 120 and gathered legs 122, 124 such that the wearer may be able to grasp them for greater control of the garment 10 limbs while donning the garment 10. Finally, such garments 10 are typically laundered and dried to remove any excessive particulates that may be present from the garment manufacturing process. This step would likely need to occur before the folding steps.

Once folded, the garment 10 may be packaged in any method as known to package such garments 10 to form a protective garment package to be delivered to the wearer. Typically, the folded garment 10 may be placed in a bag and the bag sealed to form a garment package. It may be desired that the garment package be sterilized by any sterilization as is known for such products. Additionally, it may be desirable that the air within the bag be removed during packaging, such that the garment is vacuum-packed, prior to such sterilization.

The garment 10 of the present invention is configured such that the wearer of the garment may easily don the garment 10 without touching an exterior surface of the garment and without letting any portion of the garment touch the floor. The wearer first grasps the interior surface 11 of the folded garment in such a way as to allow gravity to unfold the garment 10 into the donning configuration, such as illustrated in FIG. 2. The wearer then inserts one of their feet into the appropriate leg (22 or 24) of the garment 10, making sure that the foot passes through the leg opening (96 or 98) and engages the corresponding donning loop 36. This is then repeated for the wearer's other leg. As the wearer pulls up on the body portions 14, 16 of the garment 10, the gathered legs 122, 124 of the garment 10 will lengthen to length of the wearer's legs and provide the wearer with the appropriate leg fit.

Next, the wearer inserts one of their arms into the appropriate sleeve (18 or 20) of the garment 10, making sure that that their hand engages the corresponding donning loop 36. The donning loop 36 may be engaged with the hand, the thumb, and/or finger. This is then repeated for the wearer's other arm. As the wearer extends their arms into the sleeves 18, 20 and pulls the garment shoulders 62 over their own shoulders, the gathered sleeves 118, 120 will lengthen to the length of the wearer's arms and provide the wearer with the appropriate arm fit. The wearer then completes the donning of the garment 10 by closing the closing means 48.

In some embodiments, where the anchor strip 32 is designed to extend out of the sleeve and leg openings 92, 94, 96, 98 once the garment 10 is donned, the anchor strip 32 may provide an additional advantage in doffing the garment. When the wearer wishes to doff such a garment 10, he or she may grasp the exposed anchor strip 32 with a free hand and pull their hand or foot through the associated garment opening. Such a feature may be helpful in situations in which the wearer does not wish to touch the exterior surface of the garment after it has been worn.

The garment 10 of the present invention may also include other additional features. In FIG. 1, the garment 10 includes a neck opening 46 along the shoulder 62 of the garment 10. An additional feature for such garment 10 may be the addition a collar and/or hood fitted to such a neck opening 46. In some embodiments, such as illustrated in FIG. 3, the garment 10 may include elasticized bands 17 to provide a snugger fit to various portions of the garment 10. Another feature may be elastic cuffs added to the ankle openings 96, 98 or wrist openings 92, 94 of the garment 10 to ensure that such openings fit snugly against a wearer. Piping may be added to the garment 10 of the present invention, to allow for attachment of badges to the garment without breaching the integrity of the garment material. Such piping may additionally, or alternatively, be included for aesthetic purposes. Other features such as pockets are also considered. The garment may additionally include re-sealable openings to allow a wearer to access the interior of the garment without having to remove the garment.

The closure means 28 of the garment 10 may include any type of fastener as are common for such protective garments. Desirably, the closure means 48 will be a mechanical closure device, such as a standard zipper for barrier protection. However, it is contemplated that other fasteners such as hook-and-loop fasteners, snaps, resealable tapes, or other similar fasteners may be used, depending on the level of protection required of the garment.

The garment 10 of the present invention may alternatively incorporate an obliquely oriented opening with an associated fastener, across the front torso region of the garment, instead of a conventional vertical opening for entry into the garment. For example, a zipper may start at the shoulder and proceed diagonally across the torso down to the upper thigh region. This allows the torso of the garment to be opened wide. An angled zipper that starts away from the neck of the wearer may be less irritating. The zipper may have a flap covering it. The flap may be secured by a variety of fasteners.

Colors, symbols, words, logos, or other such indicia may be employed to communicate a particular message, such as the relative level of protection, or to provide distinctive appearance as a style element. Colors may be applied to the material of the entire coveralls, individual portions of the coveralls, or as fabric piping along seams, around pockets or leggings, or in distinctive patterns. A logo denoting branding or level of protection may be located on the coveralls. Color may be added to the closure means for communication and appearance purposes.

Such indicia may be utilized in the present invention to help the wearer identify the interior surface 11 of the garment 10, or particular area of the interior surface 11, where the wearer should grasp the garment 10 while donning the garment 10. For example, the material that is used to make the garment may be of different color, or color shade, on one side versus the other side of the material. Garments made of such a material would then have a different color, or shade, on the interior surfaces of the garment versus the exterior surfaces. Alternatively, or additionally, a symbol or a word may be printed on the interior surface 11 of the garment 10 indicating the optimal place for the wearer to grasp the garment for easy donning.

Generally speaking, the manufacture of such garments may be in accordance with known automated, semi-automated, or hand assembly procedures. For example, attachment of the various portions of the garment may be achieved utilizing sewing or stitching, ultrasonic bonding, solvent welding, adhesives, thermal bonding and similar techniques.

According to the present invention, in certain embodiments, all materials used in the protective garment have barrier properties that meet industrial standards for their respective designated level of protection. The garment materials are generally breathable and liquid resistant barrier materials. The breathability of the material increases the comfort of someone wearing such a garment, especially if the garment is worn under high heat index conditions, vigorous physical activity, or long periods of time. Various suitable woven and non-woven barrier materials are known and used in the art for garments such as surgical gowns, coveralls, industrial protective garments, and the like. All such materials are within the scope of the present invention.

The material used to form the garment may be one or more bonded carded webs, webs of spunbonded fibers, webs of meltblown fibers, webs of spunlaced fibers, webs of other nonwoven materials, one or more knit or woven materials, one or more films, and combinations thereof. The material may be formed from polymers such as, for example, polyamides, polyolefins, polyesters, polyvinyl alcohols, polyurethanes, polyvinyl chlorides, polyfluorocarbons, polystyrenes, caprolactams, copolymers of ethylene and at least one vinyl monomer, copolymers of ethylene and n-butyl acrylate, and cellulosic and acrylic resins, and mixtures and blends of the same. If the material is formed from a polyolefin, the polyolefin may be polyethylene, polypropylene, polybutene, ethylene copolymers, propylene copolymers and butene copolymers.

Multiple layers of seamless sheet material may be joined into a seamless laminate and used to form garments having desirable barrier properties. Laminates can be formed by combining layers of seamless sheet materials with each other and/or forming or depositing layers of such materials on each other. For example, the material may be a laminate of two or more nonwoven webs. As a further example, the material may be a laminate of at least one web of spunbonded fibers and at least one web of meltblown fibers and mixtures thereof.

For example, useful multi-layer materials may be made by joining at least one web of meltblown fibers (which may include meltblown microfibers) with at least one spunbonded continuous filament web. An exemplary multi-layer seamless material useful for making the protective garment of the present invention is a nonwoven laminated fabric constructed by bonding together layers of spunbonded continuous filaments webs and webs of meltblown fibers (which may include meltblown microfibers) and may also include a bonded carded web or other nonwoven fabric.

An exemplary three-layer fabric having a first outer ply of a spunbonded web, a middle ply of a meltblown web, and a second outer ply of a spunbonded web may be referred to in shorthand notation as SMS. Such fabrics are described in detail in U.S. Pat. Nos. 4,041,203, 4,374,888, and 4,753,843, all of which patents are assigned to the Kimberly-Clark Corporation, the assignee of the present invention.

An exemplary material which could be used for the manufacture of protective garment of the present invention is laminated fabric constructed by bonding together at least one layer of a nonwoven web with at least one layer of a film. Generally speaking, the film layer may range in thickness from about 0.25 mil to about 5.0 mil. For example, the film will have a thickness ranging from about 0.5 mil to about 3.0 mil. Desirably, the film will have a thickness ranging from about 1.0 mil to about 2.5 mil.

Exemplary film layers include films formed from polymers which may include polyamides, polyolefins, polyesters, polyvinyl alcohols, polyurethanes, polyvinyl chlorides, polyfluorocarbons, polystyrenes, caprolactams, copolymers of ethylene and at least one vinyl monomer, copolymers of ethylene and n-butyl acrylate, and cellulosic and acrylic resins. If the film layer is made of a polyolefin, the polyolefin may be polyethylene, polypropylene, polybutene, ethylene copolymers, propylene copolymers and butene copolymers and blends of the above.

According to the invention, the seamless sheet material of the garment 10 of the present invention may have a basis weight ranging from about 15 gsm (i.e., grams per square meter) to about 300 gsm. For example, the seamless sheet material may have a basis weight ranging from about 20 gsm to about 100 gsm. Desirably, the material may have a basis weight ranging from about 20 gsm to about 75 gsm.

For example, the material may be made from various forms of calendared nonwoven materials, such as Dupont Tyvek® brand high-density polyethylene materials. Garments made of Tyvek® have been used for hazardous environments or for general, non-hazardous, industrial use. Examples of uses for hazardous environments include protection against water-based acids, bases, salts and splashes of certain liquids, such as pesticides and herbicides. The garments also provide a reliable barrier against exposure to harmful dry particles, such as lead dust, asbestos and particles contaminated with radiation. Non-hazardous, industrial uses include wearing the garments for "dirty jobs" at factories, workshops, engineering plants, farms and construction sites.

The resistance hydrostatic pressure (hydrohead) of the protective articles will depend, in part, on the particular kind of material from which the article is constructed. The garment may be designed to have a liquid hydrohead resistance of at least about 15, 17 or 20 millibars, up to about 180, 187, or 200 millibars, inclusive of all range combinations thereinbetween. More commonly, the garment may have a hydrohead resistance of about 25 or 30 to about 115 millibars, preferably between about 45 to about 110 millibars, and more preferably between about 50 millibars to about 95 millibars of pressure.

The air permeability of the garment materials, may range from at least about 2 cubic feet per meter (cfm) up to about 47 or 50 cfm, inclusive of all range combinations thereinbetween. More typically, the air permeability may be in the range from about 5 or 10 cfm to about 43 or 45 cfm, and preferably between about 15, 17, 20, or 25 cfm to about 40 or 42 cfm.

The garment may have a moisture vapor transmission rate (MVTR) of up to about 4700 $g/m^2/24$ hours, more typically about between about 2700 or 3600 MVTR to about 4500 or 4600 MVTR. The protective garment may protect the wearer resistance of about 9-100% against dry particle barrier intrusion of a particle size of 0.3-05 microns.

The garment may be made from a material that provides a barrier to dust and microparticulates (e.g., ranging in size from about 0.05-0.10 microns or larger (see, e.g., U.S. Pat. No. 5,491,753) or light-splash fluids. The materials of the garment may also be electret-treated to generate a localized electrostatic charge within the fibers of the nonwoven web (e.g., U.S. Pat. No. 5,401,446 to Tsai). For example, these materials may be treated with compositions such as Zepel® and Zelec®, available from E. I. du Pont De Nemours, located in Wilmington, Del.

The present invention has been described in general and in detail by way of examples. Persons of skill in the art understand that the invention is not limited to the specific embodiments disclosed. Modification and variations of the general concept may be made without departing from the scope of the invention as defined by the following claims or equivalents, including, equivalent components.

We claim:

1. A sterile protective garment comprising:

a body portion;

a right leg and a left leg, where both legs extend from the body portion;

a right sleeve and a left sleeve, where both sleeves extend from the body portion; and a sheath on an interior surface of a portion of each leg and each sleeve and an anchor strip within the sheath, where the anchor strip may be used to foreshorten the legs and sleeves;

where each leg and each sleeve further comprise an opening, the opening distal to the body portion, and a donning loop associated with the opening, where the garment comprises a donning configuration where the sleeves and legs are foreshortened, where the donning loop associated with each leg opening is associated with said leg opening such that the foot of the wearer of said garment engages said donning loop as the foot of the wearer is extended out of said leg opening when the wearer is donning the garment, and where the donning loop associated with each sleeve opening is associated with said sleeve opening such that a portion of the hand of the wearer of said garment engages said donning loop as the hand of the wearer is extended out of said sleeve opening when the wearer is donning the garment.

2. The garment of claim 1, where the sheath is associated with a seam of the garment.

3. The garment of claim 1, where the sheath comprises a portion of the interior surface of the garment.

4. The garment of claim 1, where the sheath comprises a tubular portion of material attached to the interior surface of the garment.

5. The garment of claim 1, where the sheath within each sleeve extends from the distal opening of the sleeve to above an elbow of the sleeve, and where the anchor strip within each sheath of each sleeve is attached to the sheath above the elbow.

6. The garment of claim 1, where the sheath within the each leg extends from the distal opening of the leg to above a knee of the leg, and where the anchor strip within each sheath of each leg within is attached to the sheath above the knee.

7. The garment of claim 1, where the anchor strip within each sheath within each sleeve is attached to the sheath at the distal opening of the sleeve.

8. The garment of claim 1, where the anchor strip within each sheath within each leg is attached to the sheath at the distal opening of the leg.

9. The garment of claim 1, where the donning loop associated with the distal opening of each sleeve is a portion of the anchor strip associated with the sleeve.

10. The garment of claim 1, where the donning loop associated with the distal opening of each leg is a portion of the anchor strip associated with the leg.

11. A sterile garment package comprising:

a garment according to claim 1, where the garment is configured in its donning configuration and where the garment is folded such that an interior surface of the garment is available for a wearer to grasp without touching an exterior surface of the garment;

a bag, where the bag contains the garment, and where bag containing the garment is sealed and sterilized.

12. The package of claim 11, where the bag containing the garment is vacuum packaged.

13. A method of preparing a protective garment for donning, the method comprising the steps of:

a) providing a garment according to claim 1; and b) foreshortening the legs and sleeves of the garment by manipulation of the anchor strip.

14. A method of donning a sterile garment prepared for donning as in claim 13, the method comprising the steps:

grasping the folded garment by the interior surface without touching the exterior surface and without allowing any part of the garment to touch the floor;

inserting a foot and leg of a wearer into the appropriate leg of the garment and placing the foot into the donning loop of the distal opening of the leg, and then repeating with the other foot and leg of the wearer into the other leg of the garment and placing the other foot into the donning loop of the distal opening of the other leg;

pulling the body portion of the garment over the torso of the wearer and thus extending the legs of the garment to the full length of the legs of the wearer;

inserting a hand and arm of the wearer into the appropriate sleeve of the garment and placing the thumb or finger of the wearer's hand into the donning loop of the distal opening of the sleeve, and then repeating with the other hand and arm of the wearer into the other sleeve of the garment and placing the other thumb or finger into the donning loop of the distal opening of the other sleeve;

fully extending the sleeves of the garment to the full length of the wearer's arms; and closing the garment.

15. The method of claim 13, further comprising the step:

c) folding the garment such that a wearer may grasp the garment by the interior surface of the body portion without touching an exterior surface of the garment.

16. The method of claim 15, where in step (c) the garment is folded by first folding the foreshortened sleeves to the back side of the garment, then folding the foreshortened legs to the back side of the garment, and then exposing the interior surface.

17. The method of claim 15, further comprising the step:

d) placing the folded garment into a bag and sealing the bag; and e) sterilizing the bag containing the folded garment.

18. The method of claim 17, further comprising the step of laundering the garment prior to folding the garment.

19. The method of claim 17, where in the step (d) substantially all of the air is removed from the bag prior to sealing the bag.

* * * * *